US010173097B2

(12) United States Patent
Gomberg et al.

(10) Patent No.: US 10,173,097 B2
(45) Date of Patent: Jan. 8, 2019

(54) ADJUSTABLE REHABILITATION AND EXERCISE DEVICE

(71) Applicant: ROM3 Rehab LLC, Las Vegas, NV (US)

(72) Inventors: Sanford Gomberg, Las Vegas, NV (US); Peter Arn, Pasadena, CA (US); Stephen T. Sullivan, Cheyenne, WY (US); Sean P. Allison, York, PA (US)

(73) Assignee: ROM3 Rehab LLC, Las Vegas, NV (US)

( * ) Notice: Subject to any disclaimer, the term of this patent is extended or adjusted under 35 U.S.C. 154(b) by 0 days.

(21) Appl. No.: 15/700,327

(22) Filed: Sep. 11, 2017

(65) Prior Publication Data

US 2018/0071571 A1 Mar. 15, 2018

Related U.S. Application Data

(60) Provisional application No. 62/393,348, filed on Sep. 12, 2016.

(51) Int. Cl.
*A63B 22/00* (2006.01)
*A63B 22/06* (2006.01)
(Continued)

(52) U.S. Cl.
CPC .... *A63B 22/0015* (2013.01); *A63B 21/00069* (2013.01); *A63B 21/015* (2013.01);
(Continued)

(58) Field of Classification Search
None
See application file for complete search history.

(56) References Cited

U.S. PATENT DOCUMENTS 59,915 A 11/1866 Lallement
363,522 A 5/1887 Knous
(Continued)

FOREIGN PATENT DOCUMENTS

CN 105620643 A 6/2016
DE 95019 1/1897
(Continued)

OTHER PUBLICATIONS

PCT International Search Report and Written Opinion, PCT/US17/50895 dated Jan. 12, 2018.

*Primary Examiner* — Stephen R Crow
(74) *Attorney, Agent, or Firm* — Luedeka Neely Group, PC

(57) ABSTRACT

An adjustable rehabilitation and exercise device, including a rotary member rotatable about a hub and having an elongated slot defined thereon extending radially relative to the hub, the slot including a plurality of spaced apart and opposed fingers along the length of the slots, with a plurality of gaps defined between the fingers of each side of the slot; and a mount selectively and movably positionable on a selected location on the slot of the rotary member to select an angular location of the mount. The mount includes a sliding member movably positionable along the slot to a selected radial location along the selected slot to select a radial location of the mount relative to the hub of the rotary member. The sliding member is configured to slidingly engage the slot, the slide member having at least one spring loaded lock configured to engage one of the gaps to lock the position of the sliding member, and a key operable by a user to disengage the lock from the gap to enable the sliding member to be moved to another location along the slot. A patient engagement member is connectable to the mount and movable with the mount.

3 Claims, 7 Drawing Sheets

(51) Int. Cl.

| | |
|---|---|
| ***A63B 21/00*** | (2006.01) |
| ***A63B 21/015*** | (2006.01) |
| ***A63B 69/16*** | (2006.01) |
| *A63B 21/22* | (2006.01) |

(52) U.S. Cl.

CPC ..... *A63B 22/0002* (2013.01); *A63B 22/0046* (2013.01); *A63B 22/0605* (2013.01); *A63B 69/16* (2013.01); *A63B 21/225* (2013.01); *A63B 22/0005* (2015.10); *A63B 22/0007* (2013.01); *A63B 2022/0611* (2013.01); *A63B 2022/0623* (2013.01); *A63B 2022/0635* (2013.01); *A63B 2069/161* (2013.01); *A63B 2220/30* (2013.01); *A63B 2225/09* (2013.01)

(56) References Cited

U.S. PATENT DOCUMENTS

| | | | | |
|---|---|---|---|---|
| 446,671 | A | 2/1891 | Elliott | |
| 610,157 | A | 8/1898 | Campbell | |
| 631,276 | A | 8/1899 | Bulova | |
| 823,712 | A | 6/1906 | Uhlmann | |
| 1,149,029 | A | 8/1915 | Clark | |
| 1,227,743 | A | 5/1917 | Burgedorff | |
| 1,784,230 | A | 12/1930 | Freeman | |
| 3,081,645 | A | 3/1963 | Bergfors | |
| 3,100,640 | A | 8/1963 | Weitzel | |
| 3,137,014 | A | 6/1964 | Meucci | |
| 3,143,316 | A | 8/1964 | Shapiro | |
| 3,713,438 | A | 1/1973 | Knutsen | |
| 3,888,136 | A | 6/1975 | Lapeyre | |
| 4,079,957 | A | 3/1978 | Blease | |
| 4,446,753 | A | 5/1984 | Nagano | |
| 4,477,072 | A | 10/1984 | DeCloux | |
| 4,509,742 | A | 4/1985 | Cones | |
| 4,606,241 | A | 8/1986 | Fredriksson | |
| 4,611,807 | A | 9/1986 | Castillo | |
| 4,648,287 | A | 3/1987 | Preskitt | |
| 4,673,178 | A | 6/1987 | Dwight | |
| 4,850,245 | A | 7/1989 | Feamster et al. | |
| 4,858,942 | A | 8/1989 | Rodriguez | |
| 4,915,374 | A | 4/1990 | Watkins | |
| 4,930,768 | A | 6/1990 | Lapcevic | |
| 4,961,570 | A | 10/1990 | Chang | |
| 5,027,794 | A | 7/1991 | Pyle | |
| 5,161,430 | A * | 11/1992 | Febey | B62M 3/02 74/594.1 |
| 5,247,853 | A | 9/1993 | Dalebout | |
| D342,299 | S | 12/1993 | Birrell et al. | |
| 5,282,748 | A | 2/1994 | Little | |
| 5,316,532 | A | 5/1994 | Butler | |
| 5,324,241 | A | 6/1994 | Artigues et al. | |
| 5,336,147 | A | 8/1994 | Sweeney | |
| 5,338,272 | A | 8/1994 | Sweeney | |
| 5,361,649 | A | 11/1994 | Slocum | |
| 5,458,022 | A | 10/1995 | Mattfeld et al. | |
| 5,566,589 | A | 10/1996 | Buck | |
| 5,580,338 | A | 12/1996 | Scelta et al. | |
| 5,676,349 | A | 10/1997 | Wilson | |
| 5,685,804 | A | 11/1997 | Whan-Tong et al. | |
| 5,860,941 | A | 1/1999 | Saringer et al. | |
| 5,950,813 | A | 9/1999 | Hoskins et al. | |
| 6,053,847 | A | 4/2000 | Stearns et al. | |
| 6,077,201 | A | 6/2000 | Cheng | |
| 6,102,834 | A | 8/2000 | Chen | |
| 6,155,958 | A | 12/2000 | Goldberg | |
| 6,253,638 | B1 | 7/2001 | Bermudez | |
| 6,371,891 | B1 | 4/2002 | Speas | |
| 6,430,436 | B1 | 8/2002 | Richter | |
| 6,474,193 | B1 | 11/2002 | Farney | |
| 6,543,309 | B2 | 4/2003 | Heim | |
| 6,589,139 | B1 | 7/2003 | Butterworth | |
| 6,640,662 | B1 | 11/2003 | Baxter | |
| 6,820,517 | B1 | 11/2004 | Farney | |
| 6,865,969 | B2 | 3/2005 | Stevens | |
| 6,895,834 | B1 | 5/2005 | Baatz | |
| 7,204,788 | B2 * | 4/2007 | Andrews | B62M 3/02 482/57 |
| 7,226,394 | B2 | 6/2007 | Johnson | |
| 7,594,879 | B2 | 9/2009 | Johnson | |
| 9,044,630 | B1 | 6/2015 | Lampert et al. | |
| 9,480,873 | B2 | 11/2016 | Chuang | |
| 2003/0092536 | A1 | 5/2003 | Romanelli et al. | |
| 2004/0194572 | A1 | 10/2004 | Kim | |
| 2005/0020411 | A1 | 1/2005 | Andrews | |
| 2005/0085353 | A1 | 4/2005 | Johnson | |
| 2005/0274220 | A1 | 12/2005 | Reboullet | |
| 2006/0003871 | A1 | 1/2006 | Houghton et al. | |
| 2008/0161166 | A1 | 7/2008 | Lo | |
| 2009/0211395 | A1 | 8/2009 | Mul'e | |
| 2012/0167709 | A1 | 7/2012 | Chen et al. | |
| 2017/0113092 | A1 | 4/2017 | Johnson | |
| 2018/0071565 | A1 * | 3/2018 | Gomberg | A63B 22/0015 |
| 2018/0071566 | A1 * | 3/2018 | Gomberg | A63B 22/0015 |
| 2018/0071569 | A1 * | 3/2018 | Gomberg | A63B 22/0015 |
| 2018/0071570 | A1 * | 3/2018 | Gomberg | A63B 22/0015 |
| 2018/0071571 | A1 * | 3/2018 | Gomberg | A63B 22/0015 |
| 2018/0071572 | A1 * | 3/2018 | Gomberg | A63B 22/0015 |

FOREIGN PATENT DOCUMENTS

| | | | |
|---|---|---|---|
| DE | 7628633 | U1 | 12/1977 |
| DE | 8519150 | U1 | 10/1985 |
| DE | 3732905 | A1 | 7/1988 |
| DE | 29620008 | U1 | 2/1997 |
| DE | 19619820 | C2 | 1/2001 |
| DE | 19947926 | A3 | 4/2001 |
| EP | 0199600 | A2 | 10/1986 |
| EP | 0634319 | B1 | 10/1999 |
| EP | 1034817 | A1 | 9/2000 |
| FR | 2527541 | A2 | 12/1983 |
| GB | 141664 | A | 11/1920 |
| GB | 2336140 | A | 10/1999 |
| GB | 2372459 | A | 8/2002 |
| WO | 9809687 | A1 | 3/1998 |
| WO | 2006012694 | A1 | 2/2006 |

* cited by examiner

ADJUSTABLE REHABILITATION AND EXERCISE DEVICE

CROSS-REFERENCE TO RELATED APPLICATION

This application claims priority to U.S. Provisional Application No. 62/393,348 filed Sep. 12, 2016, entitled ADJUSTABLE REHABILITATION AND EXERCISE DEVICE, incorporated herein by reference in its entirety.

FIELD

This disclosure relates to the field of rehabilitation devices. More particularly, this disclosure relates to adjustable rehabilitation devices having improved connection and adjustability of patient engagement members.

BACKGROUND

Improvement is desired in the construction of adjustable rehabilitation and exercise devices. Adjustable rehabilitation and exercise devices having pedals on opposite sides and adjustably positionable relative to one another have been proposed. However, such designs require improvement due to the fact that the pedals tend to not remain securely mounted and detach, wobble and the like. In addition, it is desirable to provide for an adjustable rehabilitation or exercise device that is capable of providing both powered motion or user initiated motion without the need for separate devices.

Accordingly, in one aspect, the disclosure provides an adjustable rehabilitation and exercise device having improved structure for locating patient engagement members.

SUMMARY

The disclosure provides an adjustable rehabilitation and exercise devices.

In one aspect, an adjustable rehabilitation and exercise device includes a rotary member rotatable about a hub and having an elongated slot defined thereon extending radially relative to the hub, the slot including a plurality of spaced apart and opposed fingers along the length of the slots, with a plurality of gaps defined between the fingers of each side of the slot; and a mount selectively and movably positionable on a selected location on the slot of the rotary member to select an angular location of the mount.

The mount includes a sliding member movably positionable along the slot to a selected radial location along the selected slot to select a radial location of the mount relative to the hub of the rotary member. The sliding member is configured to slidingly engage the slot, the slide member having at least one spring loaded lock configured to engage one of the gaps to lock the position of the sliding member, and a key operable by a user to disengage the lock from the gap to enable the sliding member to be moved to another location along the slot.

A patient engagement member is connectable to the mount and movable with the mount. When a pair of the rotary members are used, each with a mount and a patient engagement member, the mounts enable the patient engagement members to be adjusted radially relative to the hubs of the respective rotary members and axially relative to one another.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
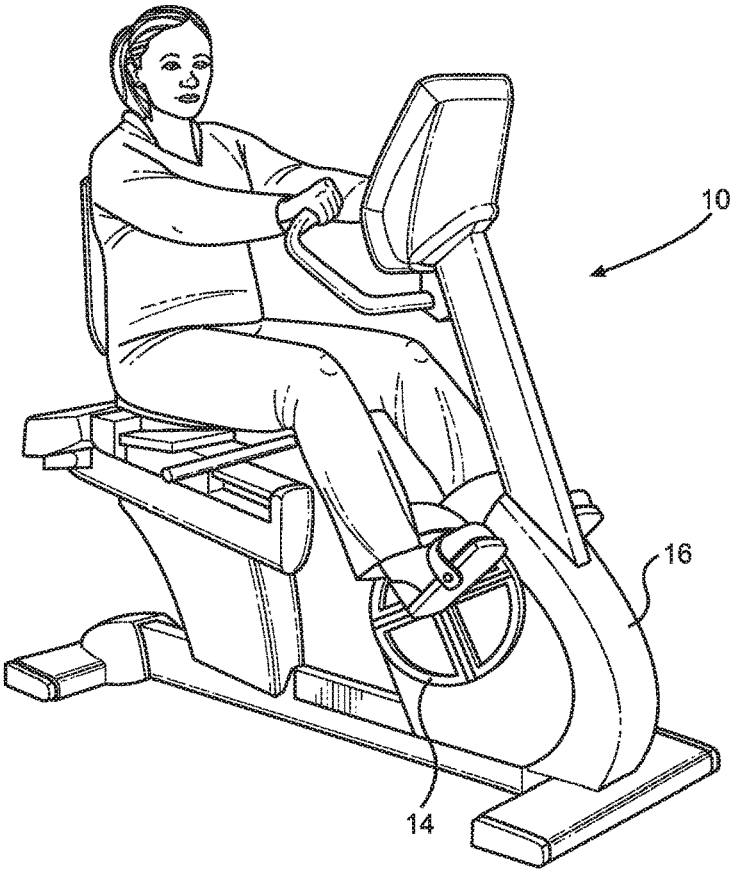
FIGS. 1A and 1B are perspective views of an adjustable rehabilitation and exercise device according to the disclosure configured to have adjustably positionable patient engagement members.
Figure 1B:
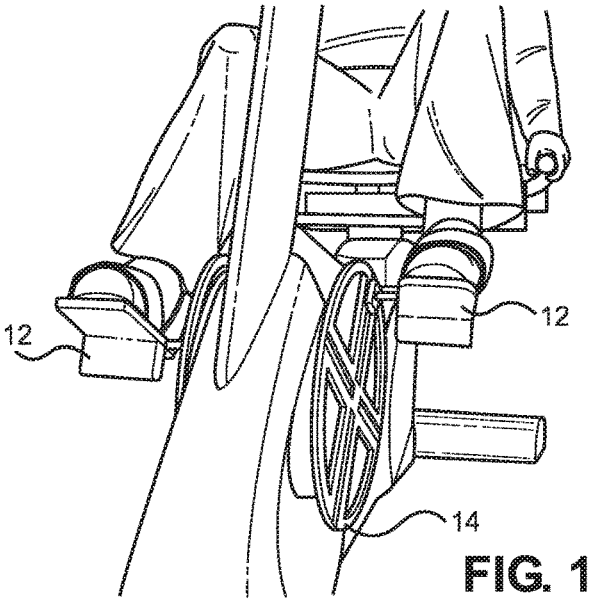

With initial reference to FIGS. 1A-1B, there is shown an adjustable rehabilitation and exercise device 10 having patient engagement members, such as pedals 12 on opposite sides that are adjustably positionable relative to one another, but securely mounted according to the disclosure to provide a more secure mounting that avoids disconnection, wobbling and the like often experienced with prior devices.

The device 10 includes a rotary device such as a wheel 14 or flywheel or the like rotatably mounted such as by a hub to a frame 16 or other support. The pedal 12 is configured for interacting with a patient to be rehabilitated and may be configured for use with lower body extremities such as the feet, legs, or upper body extremities such as the hands, arms, and the like. For example, the pedal 12 may be a conventional bicycle pedal of the type having a foot support rotatably mounted onto an axle with bearings. The axle has exposed end threads for engaging a mount on the wheel 14 to locate the pedal on the wheel 14.

The wheel 14 may be configured to have both pedals 12 on opposite sides of a single wheel. However, a preferred construction, as seen in FIGS. 1A and 1B shows a pair of the wheels 14 spaced apart from one another but interconnected to a flywheel or the like.

The rehabilitation and exercise device 10 of FIGS. 1A-1B may take the form as depicted of a traditional exercise/rehabilitation device which is more or less non-portable and remains in a fixed location, such as a rehabilitation clinic or medical practice.

Alternatively, the device 10 may be configured to be smaller and more portable unit so that it is able to be easily transported to different locations at which rehabilitation or treatment is to be provided, such as a plurality of patient's homes, alternative care facilities or the like.

Figure 2A:
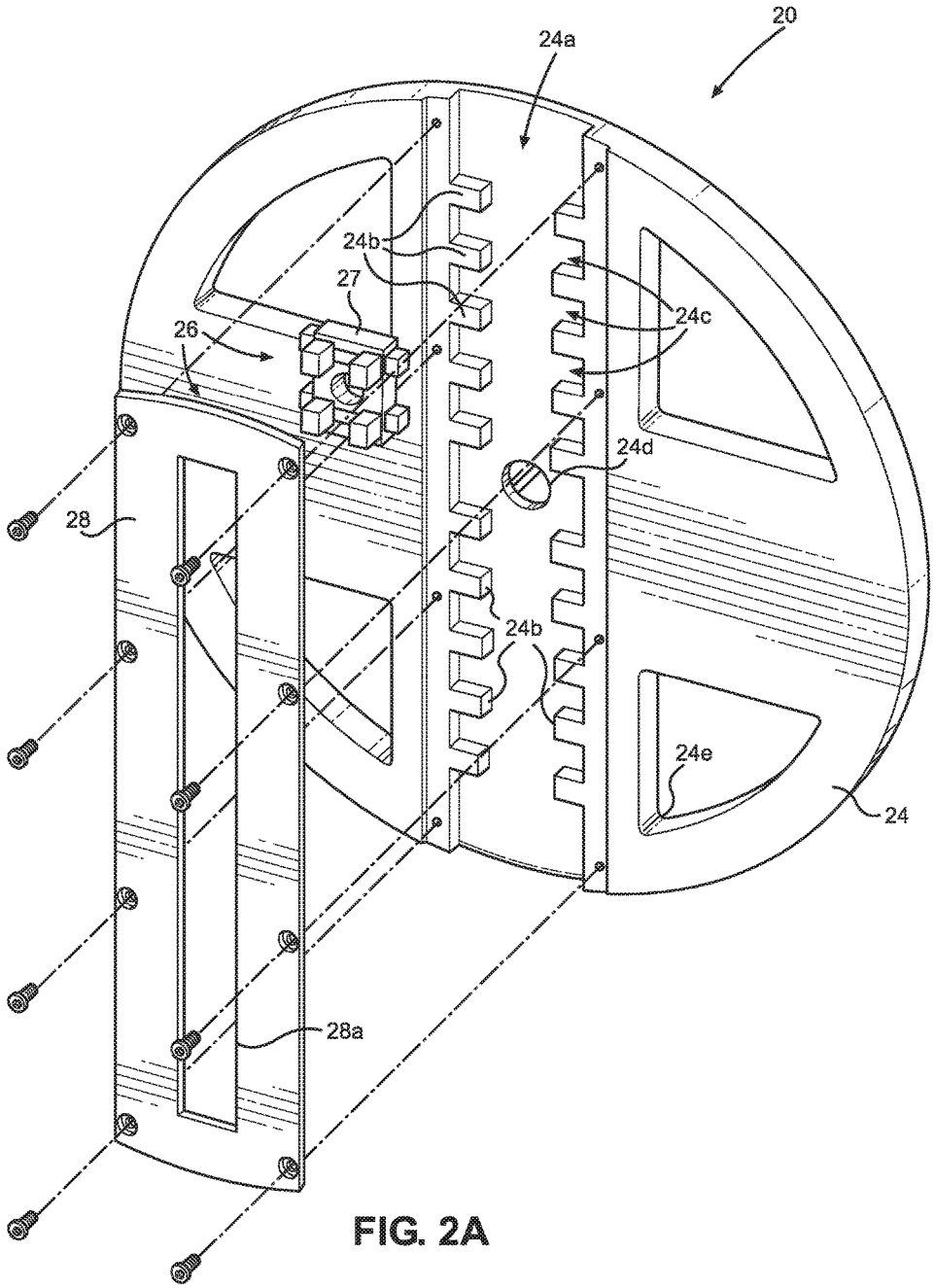
FIGS. 2A-2C show a wheel system for adjustably positioning a patient engagement member.
Figure 2B:
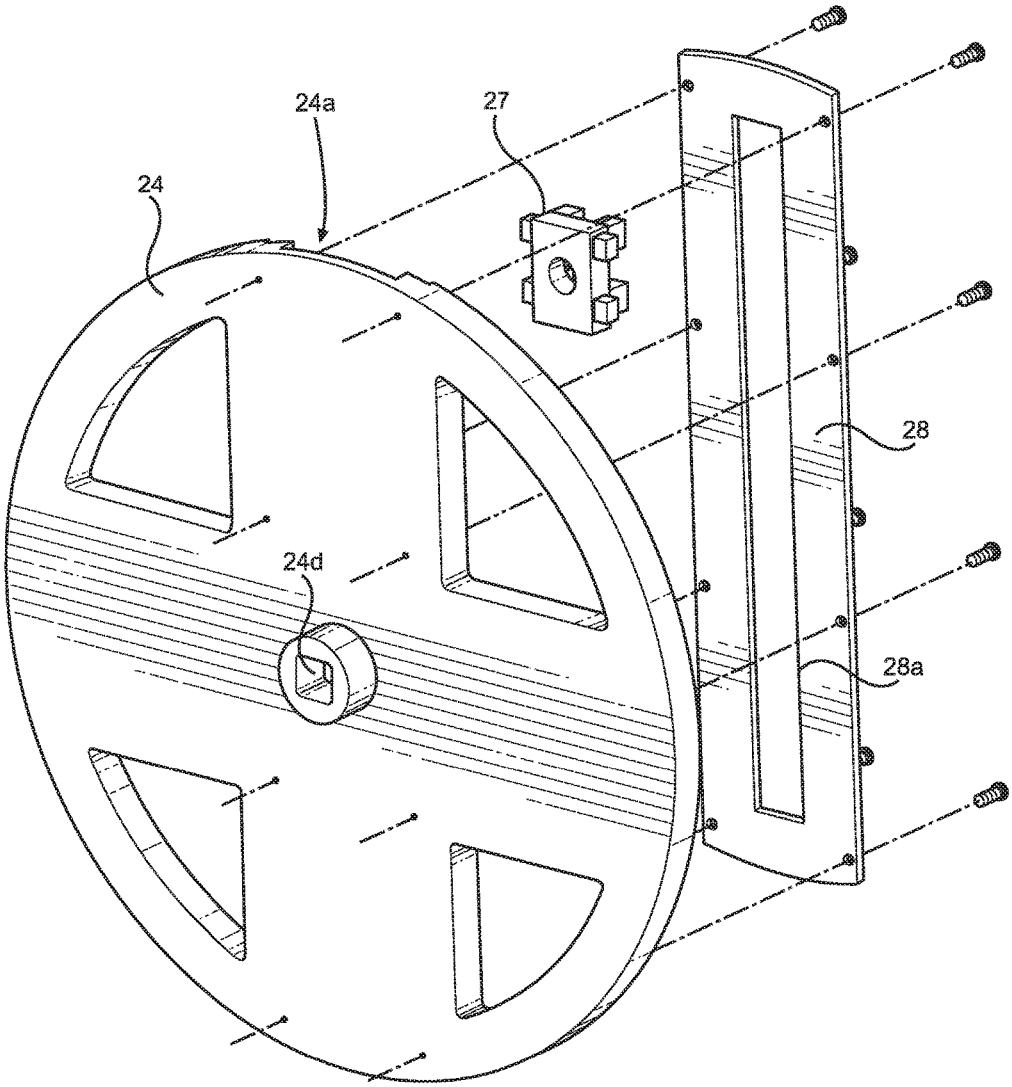
Figure 2C:
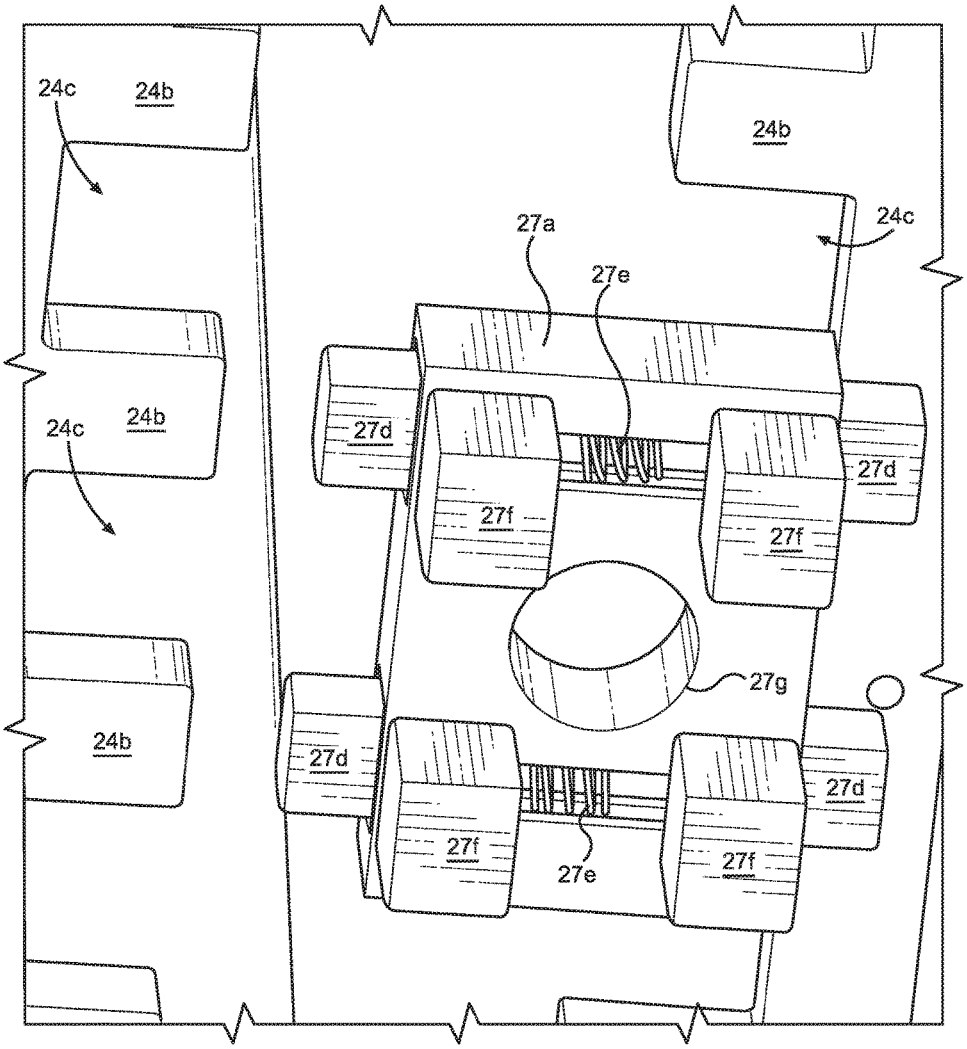

With reference to FIGS. 2A-2C, there is shown a wheel system 20 configured to be used with a device such as the device 10. The wheel system 20 is configured to have a patient engagement member, such as a pedal adjustably mountable on a wheel 24 by an adjustable mount 26.

The wheel 24 is a disk configured to include one or more elongated slots 24*a* formed on a front surface of the wheel 24 to receive the mount 26. The slots 24*a* include a plurality of spaced apart and opposed fingers 24*b* along the length of the slots 24*a*. Gaps 24*c* are defined between the fingers 24*b* of each side of the slot 24*a*.

The wheel 24 also includes a central mounting aperture 24*d* to provide a hub for rotatably mounting of the wheel 24 to the device 10. As will be appreciated, the slot 24*a* spans either side of the hub 24*c*, to effectively provide a pair of the slots 24*a* extending opposite one another relative to the hub 24*c*. Also, it will be understood that additional ones of the slots 24*a* may be located on the wheel 24 at other locations, such as perpendicular or at other angular relationships to the depicted slots 24*a*. Material of the wheel 24 may be removed to provide openings 24*e* to provide aesthetics and for reducing the weight and the cost of the wheel 24.

The mount 26 includes a sliding member 27 configured to slidingly engage the slot 24*a* and a cover plate 28 configured to cover the slot 24*a* and maintain the sliding member 27 within the slot 24*a*. The sliding member 27 includes a housing 27*a* configured to fit in the slot 24*a*, and to slide between the opposed fingers 24*b*. The housing 27*a* includes a pair of bores 27*b* extending internally across the width of the housing 27*a*, with each of the bores 27*b* being open across a portion of a front surface of the housing 27*a* to provide bore slots 27*c*. A pair of lock members 27*d* are slidingly disposed at opposite ends of the bores 27*b*, with a bias member such as a spring 27*e* disposed between the lock members 27*d* to urge the lock members 27*d* to extend outwardly from opposite ends of the bores 27*b*. Keys 27*f* connect to the lock members 27*d* and are graspable by a user to bear the lock members 27*d* within the bore 27*b* toward one another and overcome the pressure of the spring 27*e*. The keys 27*f* connect to the lock members 27*d* through the bore slots 27*c*. A receiver 27*g* is located on the sliding member 27 for receiving a patient engagement member, such as a receiving an axle of pedal, to connect the patient engagement member to the sliding member 27.

As best seen in FIG. 2C, the sliding member 27 fits in the slot 24*a*, with the edges of the housing 27*a* fitting between opposed ones of the fingers 24*b* on opposite sides of the slot 24*a*. The lock members 27*d* extend outwardly from the housing 27*a* and into the gaps 24*c* of the slot 24*a*. When the lock members 27*d* are extended, the sliding member 27 is locked in place in the slot. However, a user may unlock the sliding member 27 by grasping the keys 27*f* and moving the keys 27*b* toward one another to overcome the pressure of the spring 27*e* to move the lock members 27*d* to locations within the housing 27*a* and disengage the lock members 27*d* from the gaps 24*c*. When the lock members 27*d* are disengaged from the gaps 24*c* of the slots 24*a*, the sliding member 27 may be slid along the slot 24*a*. When the sliding member 27 is desirably located at a different radial location relative to the hub or mounting aperture 24*c*, the user may release the keys 27*f* and the spring 27*e* will reengage the lock members 27*d* into the gaps 24*c* to lock the sliding member 27 in place again.

The cover 28 serves to maintain the sliding member 27 within the slot 24*a*. The cover 28 includes a window 28*a* through which the keys 27*f* may extend for access by the user. The cover 28 may be affixed in place to the wheel 24 over the slot 24*a* as by fasteners.

The mount 26 is configured to stably locate a pedal or other patient engagement member and eliminate wobble and the like associated with conventional devices. In addition, the mount 26 is also configured to advantageously enable substantially incremental adjustment of the position of the mount.

The mount 26 cooperates with the slot 24*a* to adjustably position the mount 26, and hence the pedal, relative to the hub of the wheel 24. Further, the availability of a plurality of slots 24*a* enables a user to select which slot 24*a* for installation of the mount 26. Thus, in combination, the mount 26 and the slots 24*a* enable radial and angular adjustment of the position of the pedal or other patient engagement member. When this manner of adjustment is used for both of the pedals on opposite sides of the device 10, it will be appreciated that the pedals, or other patient engagement members, may be adjustably positioned relative to one another angularly, with each pedal being radially adjustable relative to the hubs of the wheels.

Figure 3A:
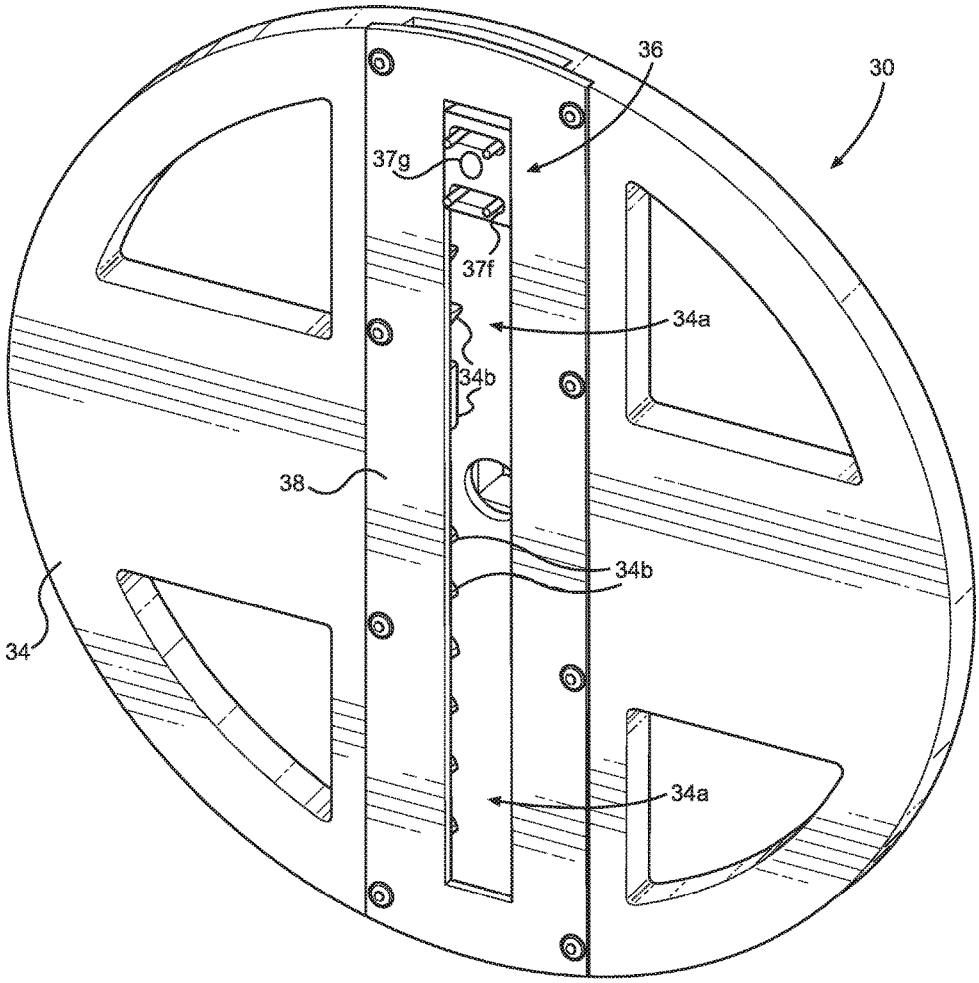
FIGS. 3A-3C show an alternate embodiment of a wheel system for adjustably positioning a patient engagement member.
Figure 3B:
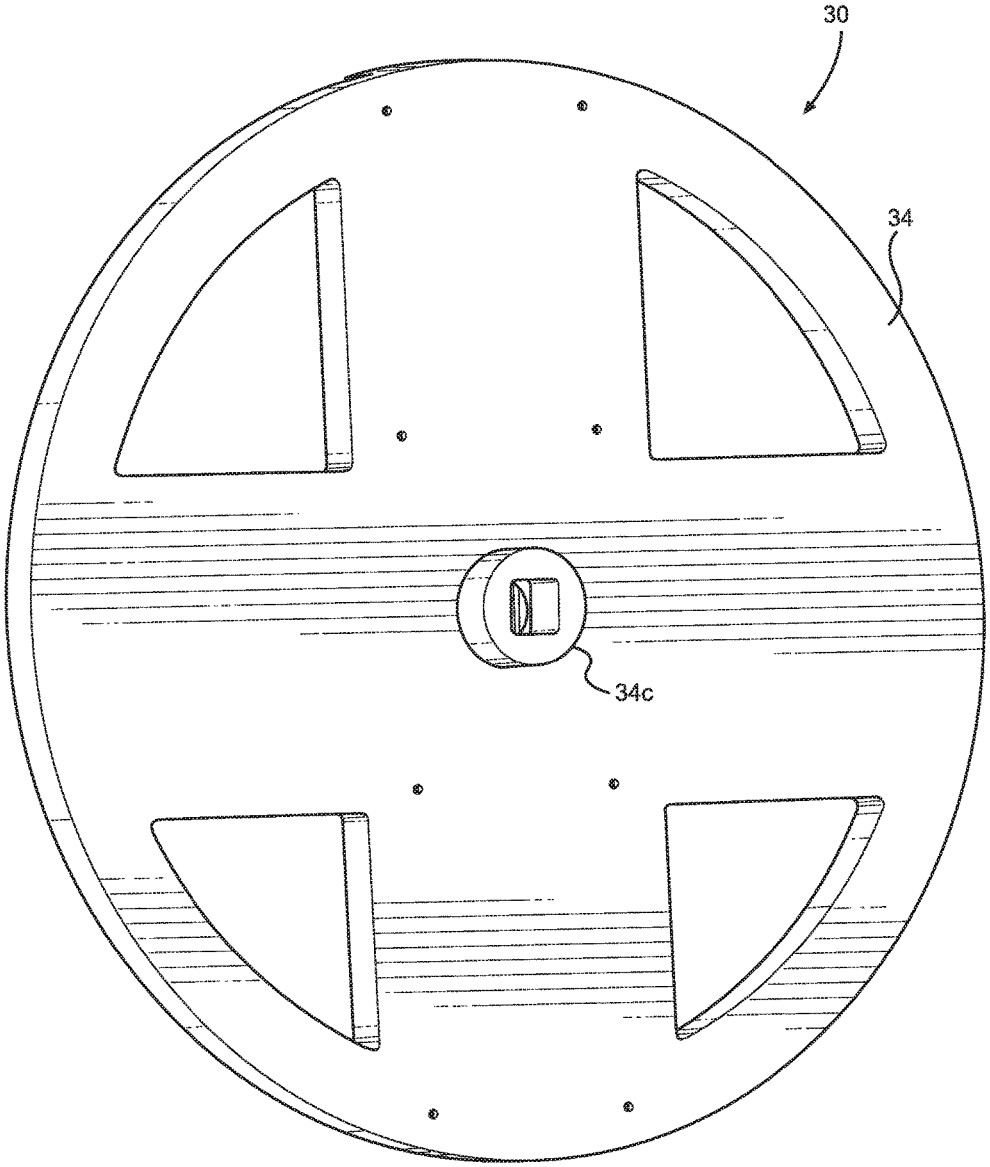
Figure 3C:
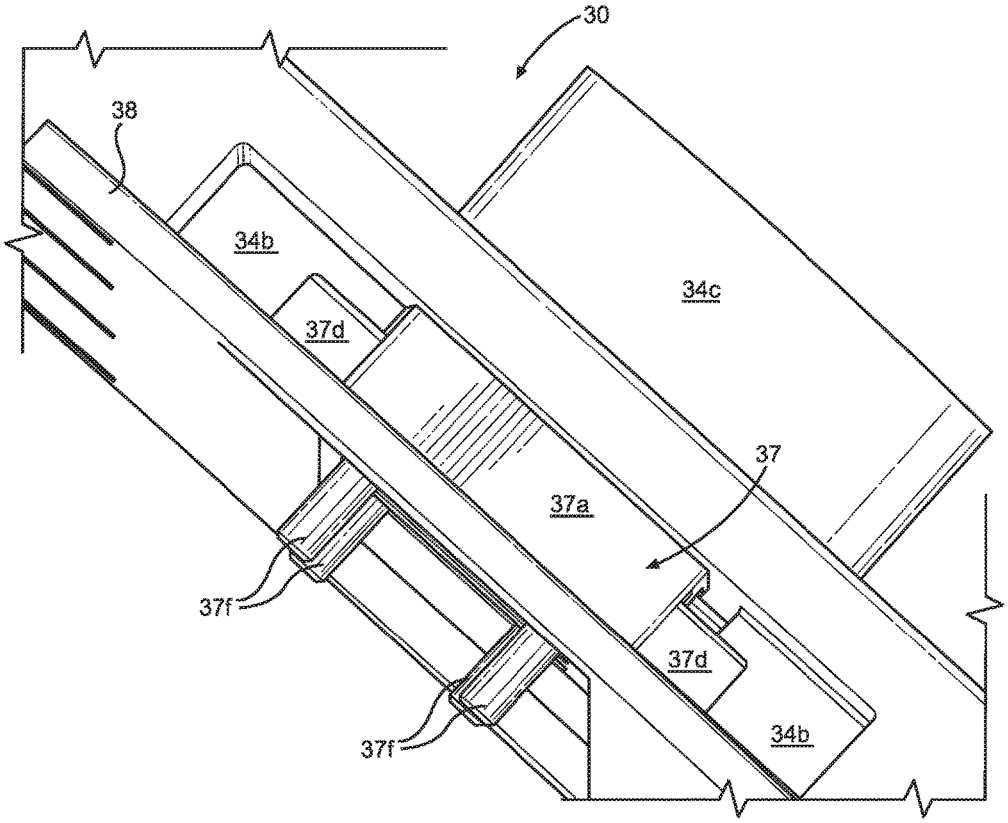

With reference to FIGS. 3A-3C, there is shown a wheel system 30 configured to be used with a device such as the device 10. The wheel system 30 is configured to have a patient engagement member, such as a pedal adjustably mountable on a wheel 34 by an adjustable mount 36.

The wheel 34 is similar to the wheel 24 and includes a disk configured to include one or more elongated slots 34*a* having spaced apart and opposed fingers 34*b*. The wheel 34 rotates about a hub or aperture 34*c*.

The mount 36 is similar to the mount 26 and includes a sliding member 37 configured to slidingly engage the slot 34*a* and a cover plate 38 configured to cover the slot 34*a* and maintain the sliding member 37 within the slot 34*a*.

The sliding member 37 is similar to the sliding member 27 and includes a housing 37*a* having lock members 37*d* operable by keys 37*f*. A receiver 37*g* is located on the sliding member 37 for receiving a patient engagement member, such as a receiving an axle of pedal, to connect the patient engagement member to the sliding member 37.

The mount 36 operates similarly to the mount 26 and stably mounts pedals, or other patient engagement members, and enables the pedals to be adjustably positioned relative to one another angularly, with each pedal being radially adjustable relative to the hubs of the wheels.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure.

The invention claimed is:

1. An adjustable rehabilitation and exercise device, comprising:

a rotary member rotatable about a hub and having an elongated slot defined thereon extending radially relative to the hub, the slot including a plurality of spaced apart and opposed fingers along the length of the slots, with a plurality of gaps defined between the fingers of each side of the slot;

a mount selectively and movably positionable on a selected location on the slot of the rotary member to select an angular location of the mount, the mount including a sliding member movably positionable along the slot to a selected radial location along the selected slot to select a radial location of the mount relative to the hub of the rotary member, the sliding member having at least one spring loaded lock configured to engage one of the gaps to lock the position of the sliding member, and a key located on said sliding member and operable by a user to disengage the lock from the gap to enable the sliding member to be moved to another location along the slot; and a patient engagement member adapted to connect to the mount and movable with the mount.

2. The device of claim 1, wherein the mount further includes a cover configured to overlie the slot and having a window to enable access to the key.

3. The device of claim 1, wherein the further comprising a second rotary member and mount, with a patient engagement member connectable to the mount, wherein the mounts enable the patient engagement members to be adjusted radially relative to the hubs of the respective rotary members and axially relative to one another.

* * * * *